United States Patent [19]

Aldrich

[11] 4,007,913

[45] Feb. 15, 1977

[54] NAIL PULLER

[76] Inventor: Ward Aldrich, 4322 North St., Akron, Mich. 48701

[22] Filed: Nov. 28, 1975

[21] Appl. No.: 636,051

[52] U.S. Cl. ..... 254/18

[51] Int. Cl.[2] ..... B25C 11/00

[58] Field of Search ..... 254/18, 20

[56] References Cited

UNITED STATES PATENTS 2,709,570 5/1955 Henry ..... 254/18

FOREIGN PATENTS OR APPLICATIONS 280,143 11/1927 United Kingdom ..... 254/20

*Primary Examiner*—Al Lawrence Smith
*Assistant Examiner*—Robert C. Watson
*Attorney, Agent, or Firm*—John J. Swartz

[57] ABSTRACT

A hand-held nail puller for extracting nails including nail gripping jaws mounted for linear movement and coupled to a rotary, threaded drive cylinder which is rotatably driven by a linearly reciprocable plunger to linearly move the jaws and extract a nail gripped by the jaws.

19 Claims, 14 Drawing Figures

NAIL PULLER

BACKGROUND OF THE INVENTION

Conventionally, carpenters utilize a claw hammer for extracting nails from wood. If the head of a nail is embedded in wood, it is extremely difficult, if not impossible to withdraw the nail via a conventional claw hammer. Carpenters frequently carry along a pry bar which they utilize to initially pry the nails out of the wood so that a claw hammer can gain purchase on the nail. This necessitates an additional tool which adds to the cost and reduces the carpenter's efficiency. One device, sometimes known as a "cats claw", has been utilized to extract nails having the head thereof buried in wood, but once again a hammer must be utilized to sink the claws into the wood about the head of the nail.

Other devices have been provided for extracting nails but they are awkward to use and cumbersome so as to render them substantially useless by any tradesman.

Nail pulling apparatus constructed according to the present invention can be carried in a tool box, and easily and simply used to grip and extract nails from wood and the like.

Most nail pulling devices operate on the principal of a lever which is pivotal about a fulcrum and mounts claws at one end thereof for underlying the nail head to withdraw the nail as the lever swings. The lever necessarily moves in an arcuate path and forces the nail to also follow an arcuate path. Long nails extracted in such a fashion are generally permanently deformed and of limited further utility.

It is another object of the present invention to provide a nail extractor which is movable in a linear path to extract nails without bending them.

A nail extractor which operates on the lever principal must have the claws slid sidewisely under the nail head which necessitates an additional tool to partially extract the nail so that the claws slide under the nail head. Accordingly, it is a further object of the present invention to provide a single nail pulling device which includes nail head gripping jaws that will radially expand to longitudinally slide over the head of a nail as the jaws are linearly moved toward the nail.

It is another object of the present invention to provide a nail extracting device of the type described which will easily grip the head of a nail that is embedded in wood and then linearly extract the nail.

The present invention incorporates radially expandable nail gripping jaws and a rotary member which is threadedly coupled to the nail gripping jaws to linearly move the jaws as the member is rotated. It would be awkward and unnatural for a carpenter to manually grasp the member and rotate the drive cylinder by hand and thus it is a still further object of the present invention to provide linearly movable apparatus for driving the rotary member to extract the nail.

It is another object of the present invention to provide a nail puller including linearly reciprocable radially expandable nail gripping jaws driven by a rotatable screw and a linearly reciprocable drive member movable in a to and fro path, and motion translating mechanism which will translate the linear motion of the reciprocable member to rotary motion of a screw and thence translate the rotary motion of the screw to linear motion which moves the claws to a removed position.

Other objects and advantages of the present invention will become apparent to those of ordinary skill in the art as the description thereof proceeds.

SUMMARY OF THE INVENTION

A nail extractor for extracting a longitudinally extending nail including radially expandable object gripping jaw mechanism for gripping an object, means mounting the jaw mechanism for longitudinal movement between a longitudinally outer position adjacent an article having a nail therein and a longitudinally withdrawn position; mechanism for longitudinally withdrawing the object gripping jaw mechanism between the adjacent and withdrawn positions including linearly reciprocable drive mechanism movable in a to and fro longitudinal path of travel, and rotatable mechanism responsive to movement of the drive mechanism in one direction only for linearly withdawing the jaw mechanism from said adjacent position to said withdrawn position.

The present invention may more readily be described by reference to the accompanying drawings in which.

Figure 13:
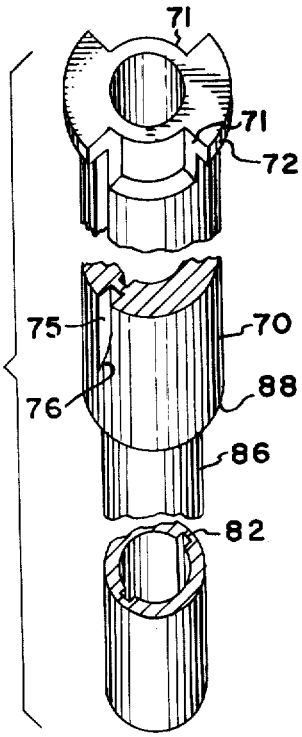
Figure 14:
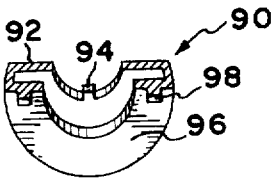

FIG. 13 is an enlarged, perspective view, partly broken away in section, illustrating a guide cylinder for moving thread engaging members to radially outer positions in which they are received in the threads of the rotatable cylinder; and FIG. 14 is an enlarged section bottom perspective view of rotary coupling sleeve for translating the linear motion of a linearly reciprocable plunger to rotary motion of a drive cylinder.

DESCRIPTION OF THE PREFERRED EMBODIMENT

Referring now more particularly to the drawings, apparatus for extracting a longitudinal nail N from a board B is illustrated generally at 10 and includes a generally vertical, elongate, hollow metal casing or cylinder 12 provided with an enlarged diameter, upper cylinder portion 14 and a reduced diameter, cylindrical lower portion 16 which is integrally joined to the upper portion via an upwardly diverging, intermediate wall portion or shoulder 17.

The cylindrical upper section 14 is closed by a cap 15. The cylindrical lower section 16 includes a funnel shaped, lowermost end section 18 having downwardly converging side wall terminating in an annular flange 18*a* which is parallel to the longitudinal axis 20 of the cylinder 10 and nail N.

Figure 11:
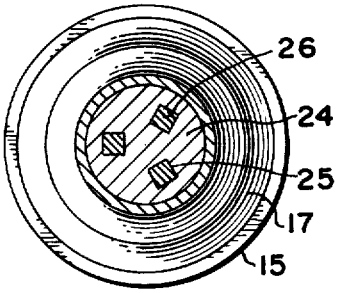
FIG. 11 is an enlarged bottom plan sectional view taken along the line 11—11 of FIG. 1.
Figure 12:
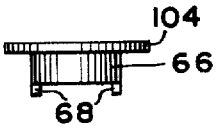
FIG. 12 is an enlarged side elevational view of the apparatus illustrated in FIG. 10.

Disposed within the lower casing section 16 for vertical movement along the cylinder axis 20 is a hollow lifting cylinder 22, having, at its lower end, a solid block 24 (FIGS. 1, 2 and 11) in the form of an inverted, truncated cone. The truncated cone or block 24 includes three equiangularly spaced, downwardly converging passages or openings 25 therethrough which slidably receive downwardly converging, radially expandable nail gripping jaws 26. The nail gripping jaws are expandable and contractible between radially spread or expanded positions in which they can pass over the head H of the nail N and contracted, nail head gripping positions illustrated in FIGS. 2 and 3 as well as the further contracted positions illustrated in FIG. 1. The lower terminal ends of the nail gripping jaws 26 will bear against the nail head H as the cylinder 10 is longitudinally moved toward the nail, as will be described more particularly herinafter, to initially force the solid block 24 downwardly relative to the jaws 26. At this time, the jaws 26 bear against the upper surface of the nail head H. As the solid block 24 continues to escape downwardly over the jaws 26 the jaws 26 are forced radially outwardly to expanded positions. The lower ends of the jaws 26 include radially inwardly disposed, upwardly converging, camming surfaces 30*a* which bear against the lateral edges of the nail Head H to enhance movement of the jaws 26 to nail head gripping positions embedded in the wood as illustrated in FIG. 2. As the cylinder 10 and block 24 move downwardly the jaws 26 radially spread apart and the cam surfaces 30*a* slide over the nail head H. The jaws 26 include radially inwardly disposed recesses 28 which receives the nail head H when the camming surfaces 30*a* have penetrated the board B in the positions illustrated in FIG. 2. The radially opposed sides of the jaws 26 converge downwardly to enhance penetration of the wood.

Figure 1:
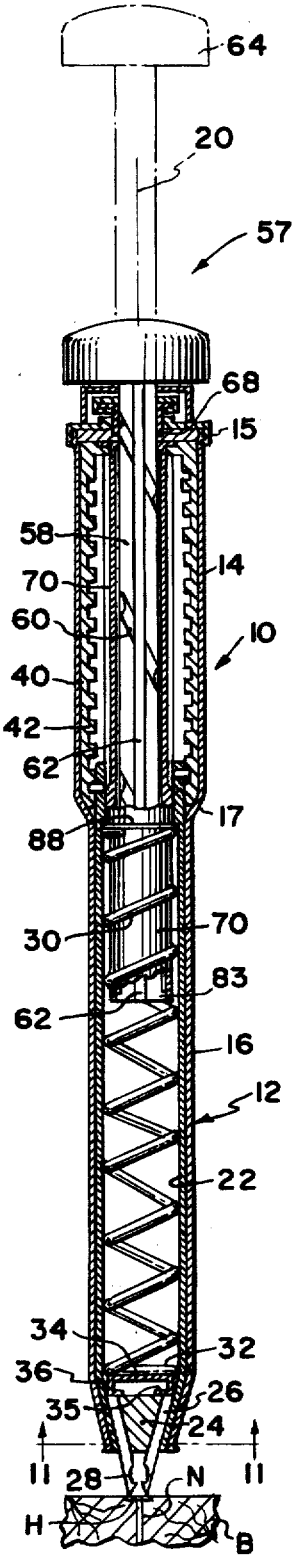
FIG. 1 is a vertical sectional side view illustrating the nail extending apparatus constructed according to the present invention, the nail gripping jaws being illustrated in radially contracted positions immediately preceeding the gripping of a nail, a linearly reciprocable drive plunger for driving the jaws being illustrated in chain lines in a raised position.
Figure 2:
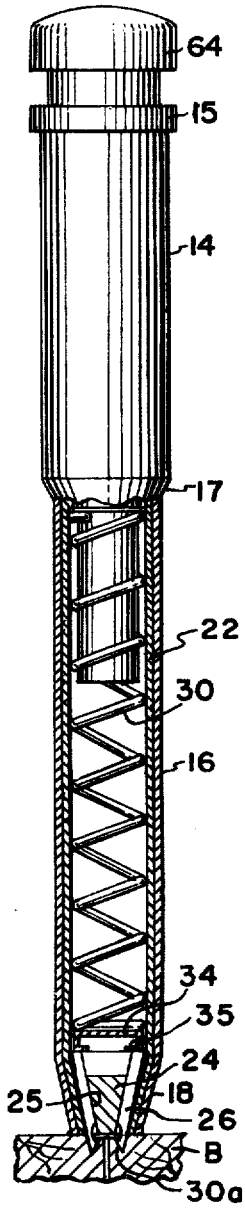
FIG. 2 is a partly sectional side elevational view similar to FIG. 1, nail extractor being illustrated in an adjusted position in which the jaws are in a radially expanded position to grip the head of a nail.

A biasing coil spring, generally designated 30, is provided for yieldably urging the nail gripping jaws 26 to the longitudinally extended, radially contracted nail head gripping positions illustrated in FIGS. 1 and 2 as well as yieldable urging the lifting cylinder 22 to the longitudinally extended position illustrated in FIGS. 1 and 2 at the lower or longitudinally outer, open end of the casing 12. The coil spring 30 will yield to permit upward movement of the nail gripping jaws 26 relative to the lifting cylinder 22 as the jaws are being set onto the nail head H as well as permitting upward movement of the lifting cylinder 22 in the casing 12 to the retracted or raised position illustrated in FIG. 3. The lower end 32 of the coil spring 30 bears against the upper side of an inverted cup-shaped disc 34 having a downwardly projecting annular rim 36 which engages enlarged heads 35 provided at the upper ends of the nail gripping jaws 26. The enlarged heads 35 prevent the jaws 26 from sliding downwardly through the openings 25 in the solid block 24.

Figure 3:
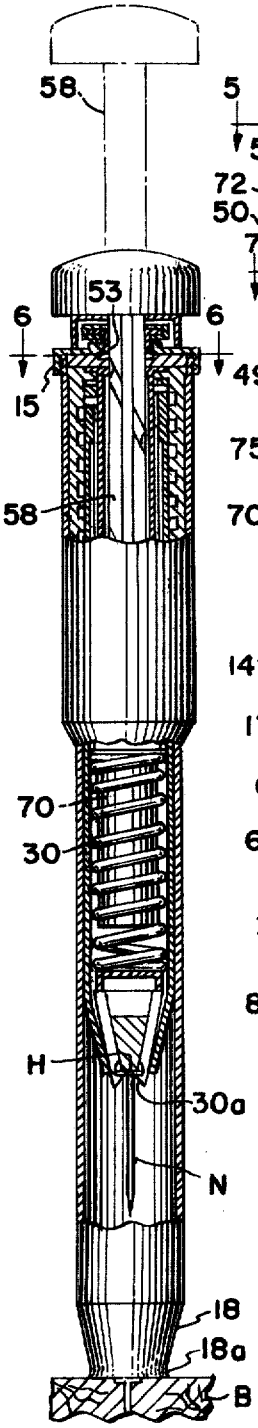
FIG. 3 is a similar partly sectional, vertical elevational view of the apparatus but illustrating the jaw members gripping an extracted nail in a raised position.
Figure 7:
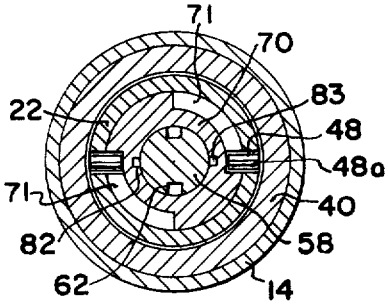
FIG. 7 is an enlarged vertical sectional view, taken along the line 7—7 of FIG. 4.

Apparatus is provided for vertically moving the lifting cylinder 22 and the nail gripping jaws 26 between the axially or downwardly outmost positions illustrated in FIG. 1 and the raised, retracted positions inside the cylinder 12, as illustrated in FIG. 3, and comprises a hollow, rotatable drive cylinder 40 having an internal spiral thread 42 defining a spiral thread groove 44. Thread engaging lift members or pins 48 are slidably received in radial passages 49 provided in a hub or shoulder 50 at the upper end of the lifting cylinder 22. In the radially outermost positions, (FIG. 7) the outermost ends 48*a* of the thread engaging pins 48 are received in the thread groove 44 so as to be driven axially upwardly when the threaded cylinder 40 is rotated.

The lower end of the drive cylinder 40 includes a downwardly converging, funnel shaped sidewall 52 which is rotatably supported by the downwardly converging shoulder 17 of the casing 12. The outer diameter of the lifting cylinder 22 is less than the internal diameter of the spiral thread 42 so as to be slidably received in the cylinder 22 when the cylinder 22 is moved upwardly to the position illustrated in FIGS. 3 and 4. The upper end of the threaded cylinder 40 is closed by a cap 51 having a central opening 53 surrounded by a plurality of vertically ratchet teeth 54 cut in the upper surface of the cap.

Apparatus is provided for rotating the internally threaded cylinder 40 and includes a vertically reciprocal plunger 57 comprising an elongate shank or shaft 58 having a spiral groove 60 cut in the outer surface thereof as well as diametrically opposed, linear, vertical grooves 62 intersecting the spiral groove 60. A hand graspable knob 64 is provided at the upper end of the stem 58 for moving the plunger 57 in a vertical to and fro path of travel.

A motion translating bushing or sleeve 66 is received on the reciprocable stem 58 and includes diametrically opposed downwardly opening pawls or teeth 68 at the lower end thereof which engage the ratchet teeth 54 on the head of the rotating cylinder 40. The pawl teeth 68 are vertically inclined in a direction opposite the inclination of the ratchet teeth 54 so that the teeth 54 and 68 will mesh to revolve the cylinder 40 only when the bushing or sleeve 66 is driven in one direction of rotation. When the sleeve is rotated in the opposite direction the teeth 68 merely escape over the ratchet teeth 54 so that there is lost motion in one direction of rotation.

The motion translating sleeve 66 includes internal teeth or projections 67 received in the spiral slot 60 provided in the outside of the plunger stem 58. As the plunger handle 64 and the plunger shaft 58 are moved upwardly, the motion translating sleeve 66 is rotated in such a direction that the teeth 68 do not drive the teeth 54 on the revolvable drive cylinder 40 and thus the cylinder 40 remains stationary. When the plunger stem 58 and the plunger head 64 are moved downwardly, the internal sleeve projections 67 are rotatably drive by the sides of the groove 60 in an opposite direction so that the pawl teeth 68 will drive the ratchet teeth 54 to revolve the drive cylinder 40.

Mounted internally of the revolving drive cylinder 40 is a thread pin engaging guide cylinder 70 having, at its upper end, a radially outwardly disposed, annular flange 72 supported by a radially inwardly projecting annular flange 74 provided on the rotatable threaded cylinder 40. The annular flange 72 is mounted so as to permit relative rotation of the cylinder 40 and the guide cylinder 70. The guide cylinder 70 is provided for biasing the thread engaging pins 48 to the radially outermost positions illustrated in FIGS. 1 and 2 as the lifting cylinder 22 moves upwardly toward the raised positions illustrated in FIG. 3.

Figure 4:
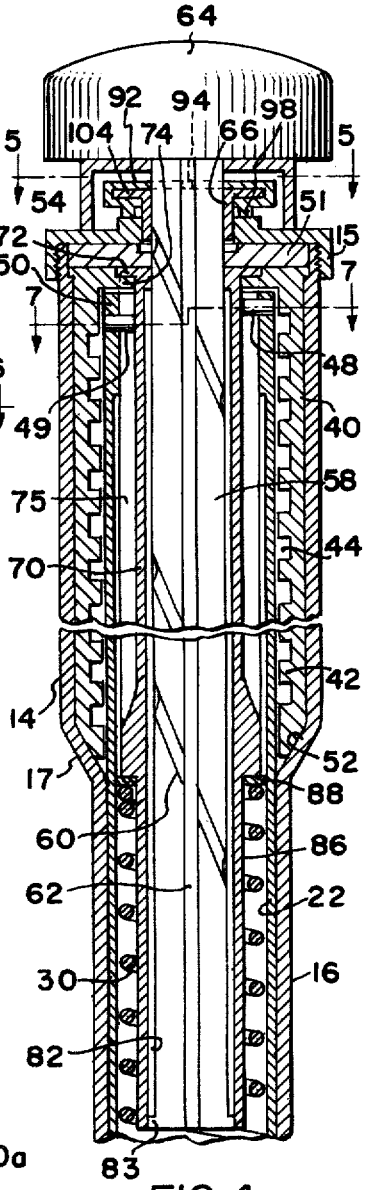
FIG. 4 is an enlarged, vertical sectional view of only an upper portion of the nail extractor.
Figure 5:
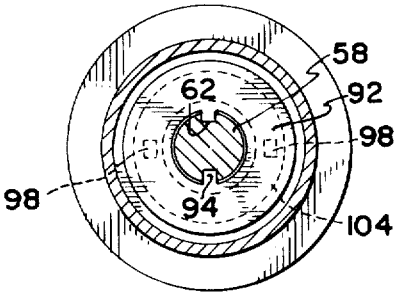
FIG. 5 is an enlarged vertical sectional view particularly illustrating a camming mechanism for selectively uncoupling a linearly reciprocable drive plunger from a rotatable threaded drive cylinder, taken along the line 5—5 of FIG. 4.
Figure 6:
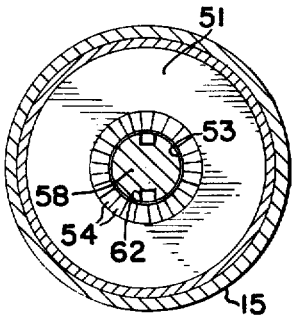
FIG. 6 is an enlarged sectional plan view taken along the line 6—6 of FIG. 3.

The guide cylinder 70 includes, at the upper end thereof, diametrically opposed, circumferentially extending recesses 71 which will radially receive the thread engaging pins 48 after the lifting cylinder 22 has been raised to its uppermost position at which time the pins 48 reach the upper end of the threaded slot 44 and are forced radially inwardly out of the thread slot 44 to the positions illustrated in FIG. 4 to be received by the recesses 71. The guide cylinder 70 is rotatable about its longitudinal axis 20 and vertical slots 75 which communicate with the recesses 72 receive the thread engaging pins 48 in one position of rotation of the guide cylinder 70 so that the lifting cylinder 22 and the nail gripping jaws 26 can be returned from the raised, retracted positions illustrate in FIGS. 3 and 4 to the axially outermost positions illustrated in FIG. 1. The lower end 76 of the pin receiving slot 75 is tapered radially outwardly so as to force the pins 48 to the radially outermost position engaging the thread 44 when the lifting cylinder 22 reaches its original starting position illustrated in FIGS. 1 and 2.

The plunger stem 58 is coupled to the guide cylinder 70 for concurrent rotation therewith via diametrically opposed, vertical slots 82 (FIGS. 4 and 13) provided on the inside of the guide cylinder 70 and cooperating tangs 83 (FIG. 4) provided at the lower end of the plunger stem 58 permitting vertical movement of the plunger stem 58 relative to the guide cylinder 70. The lower end of the guide cylinder 70 includes, at its lower end, a reduced diameter shaft section 86 which is received in the upper end of the coil spring 30 and defines a shoulder 88 against which the upper end of the spring 30 bears.

Figure 8:
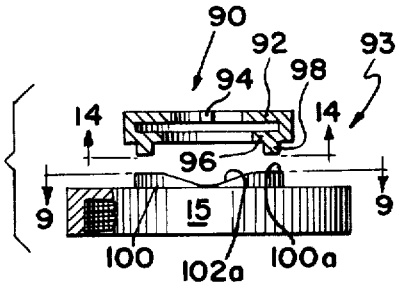
FIG. 8 is an enlarged part sectional side view of the camming apparatus for decoupling the plunger and the rotatable threaded cylinder.
Figure 9:
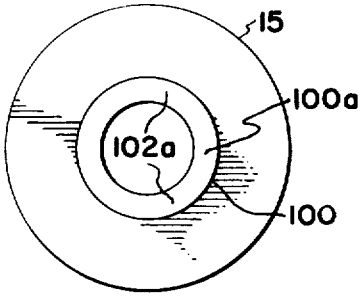
FIG. 9 is an enlarged top plan view taken along the line 9—9 of FIG. 8.

Decoupling apparatus, generally designated 93 (FIG. 8), is provided for selectively decoupling the rotatable drive cylinder 40 and the plunger stem 58, when the plunger 57 is moved vertically in a to and fro path of travel, to prevent rotation the rotatable cylinder 40 by the plunger 58. The decoupling apparatus 93 comprises a driven ring member 90 which is C-shaped in cross-section and includes an upper plate 92 having diametrically opposed radially internal projections 94 received in the vertical plunger slots 62. The driven ring member 90 includes a lower plate 96 which is parallel to the upper plate 92 and includes a pair of downwardly projecting diametrically opposed cam followers 98. A pair of circumferentially extending, diametrically opposed, V shaped cams 100 is provided on the upper surface of the cap 15 which closes the upper end of the cylinder 10. The cams 100 receive the cam followers 98 and include upper, generally horizontal cam surfaces **100*a* which support the cam followers 98 when the ring 90 is turned and the followers move along the surface 102*a* to the upper surface 100*a* (FIG. 8**).

Figure 10:
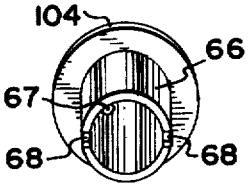
FIG. 10 is an enlarged perspective view of the coupling member which couples the reciprocable plunger to the rotatable threaded cylinder.

The cylinder driving sleeve 66 (FIG. 10) is provided with a radially outwardly disposed annular flange 104 which is received between the upper and lower ring shaped plates 92 and 96. To prevent the pawl teeth 68 on the sleeves 66 from engaging and driving the ratchet teeth 54 on the tubular member 40, the hand graspable handle 64 and the stem 58 are rotated to rotate the driven ring member 90 so that the cam followers 98 ride up on the cam surfaces **102*a* to the raised cam surface 100*a* in vertically raised positions. When the cam followers 98 reach the uppermost cam surface 100*a*, the teeth 68 are moved out of engagement with, and at a higher level than, the teeth 54 so as to prevent rotation of the internally threaded drive cylinder 40 when the plunger 58** is moved upwardly and downwardly.

OPERATION

To remove a nail N having a head H embedded in a board B the nail pulling apparatus 10, constructed according to the present invention, is moved into axial or longitudinal alignment with the shank of the nail N to the position illustrated in FIG. 4 so that the lower ends of the nail gripping jaws 26 are adjacent the head H of the nail N. The operator then turns the knob 64 about the cylinder axis 20 so that the cam followers 98 are forced to ride up the surfaces **102*a* to the raised cam surface 100*a* to disengage the pawl teeth 68 from the ratchet teeth 54. The plunger knob 64 and the plunger stem 58 are then vertically retracted to the position illustrated in chain lines in FIG. 1 and then moved downwardly very rapidly to impart a blow to the entire cylindrical casing 10 which forces the casing 10 downwardly so that the nail gripping jaws move in a compound path of travel. The jaws 26 will move linearly as well as concurrently move radially relative to the casing 10 so that the jaws 26 escape in the slots 25 to radially expanded or spread positions in which the lower nail gripping jaw ends 30*a* will spread and pass over the nail head H. The biasing spring 30 continually exerts a downward force on the jaws 26 such that the jaws are forced to penetrate the wood to the depth illustrated in FIG. 2. The nail head H is received in the internal jaw recesses 28 of the jaws 26 and the reciprocable plunger knob 64 and the plunger stem 58 are rotatably returned in an opposite direction so that the cam followers 98 are received at the lowermost portion of the cams 100 and the pawl teeth 54 and ratchet teeth 68 are again engaged. The operator than retracts the plunger 57 upwardly to the position illustrated in chain lines in FIG. 1. At this time the flange 18*a* at the lower end of the casing 10 bears against the outer surface of the wood block B. Although the teeth 54 and 68 are engaged and movement of the plunger 58 causes rotation of the drive sleeve 66 via the projections 67, the direction of rotation is such that the pawl teeth 54 merely escape over the ratchet teeth 68 and the threaded drive cylinder 40** is not rotated.

As the operator once again presses downwardly on the raised plunger handle 64, the drive sleeve 66 will be rotated in an opposite direction and the pawl teeth 68 and the ratchet teeth 54 will engage to rotatably drive the tubular drive member 40 about the axis 20. When the tubular drive member 40 rotates, the thread engaging pins 48 will be forced upwardly to raise the lifting cylinder 22, nail gripping jaws 26 and the gripped nail N upwardly. As the lifting cylinder 22 retracts upwardly, the spring 30 yieldably urges the jaws 26 to the contracted position gripping the nail head H. The amount of upward movement per each downward stroke of the stem 58 depends on the pitch of the threads. The operator repeats the described operation by moving the plunger 57 up and down until the nail N is completely withdrawn, to the position illustrated in FIG. 3. When the lifting cylinder 22 reaches the upper end of the cylinder 10, the thread engaging pins 48 will be reach the upper end of the thread slot 44 and will be biased radially inwardly to be received by the recesses 72 at the upper end of the guide cylinder 70. The operator then turns the plunger knob 64 and the stem 58 so that the pins 48 are vertically aligned with the vertical slots 74. The spring 30, which is now in a compressed state as illustrated in FIG. 3, forces the lifting cylinder 22 and the nail gripping jaws 26 to rapidly return to the axially outer most positions illustrated in FIG. 1. The nail N can be ejected from the jaws 26 by merely manually pressing upwardly on the nail N and then quickly twisting the nail sidewisely, or if desired, a release lever may be connected to the jaws 32 to force them to spread positions to release the nail.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. A nail puller comprising:

a tubular casing having an opening at at least one axial end thereof, a hollow nail lifting member mounted in said casing for axial movement therein, nail gripping jaws mounted on said lifting member for movement therewith and relative thereto between axially outward, radially contracted, nail gripping positions and radially spread, axially inwardly retracted positions;

means for axially withdrawing said lifting member and said jaws carried thereby axially inwardly in a direction away from said one end comprising:

a rotatable member received in said casing and threadedly coupled to said lifting member;

means for rotating said rotatable member comprising a linearly reciprocable member movable in a to and fro path of travel; and means reacting between said reciprocable member and said rotatable member for converting linear motion to rotary motion to drive said rotatable member when said reciprocable member is moved in one direction.

2. The nail puller as set forth in claim 1 wherein said converting means includes lost motion connection means operable in such a manner that said rotatable member is not rotated when said reciprocable member is moved in a direction opposite said one direction.

3. The puller as set forth in claim 1 wherein said lifting member comprises:

an internally threaded cylinder having internal spiral slot means, radially movable thread engaging pin members receivable in said slot means; and guide means disposed within said casing and internally receiving said reciprocable member for guiding said thread engaging lifting members radially outwardly into said slot means as said lifting member is axially inwardly retracted.

4. The nail puller as set forth in claim 3 including yieldable means for yieldably biasing said lifting member to an axially outer position at said one axial end but permitting axially inward movement of said lifting member as said rotatable member rotates; said guiding means being rotatable relative to said thread engaging pin members and including axially extending slot means for receiving, in one position of rotation, said pin members to permit said lifting member to move axially outwardly to said axially outer position.

5. The nail puller as set forth in claim 3 wherein said guide means internally receives said reciprocable member and means is provided for coupling said reciprocable member and said guide means for concurrent rotary movement but permitting relative axial movement thereof.

6. The puller as set forth in claim 1 wherein said reciprocable member is mounted for at least limited rotary motion and includes a spiral groove extending spirally in an axial direction about the outside surface thereof, and driver means for driving said rotatable member is coupled to said rotatable member and includes a portion received in said groove to be rotated thereby when said reciprocable means is moved.

7. The nail puller as set forth in claim 6 wherein said driver means is movable between a position coupled to said rotatable member and an uncoupled position, and means is provided for moving said driver means between said coupled and uncoupled positions in response to relative rotation of said rotary member and said reciprocable member.

8. The nail puller as set forth in claim 7 wherein said means for moving said reciprocable means includes additional groove means and said driver means includes a portion received in said additional groove means to be rotatably driven thereby when said reciprocable means rotates but permitting reciprocable movement of said reciprocable means, said driver means and said casing including cooperating cam and cam follower means for axially moving said driver means to said uncoupled position when said reciprocable means and said casing are relatively rotated.

9. A device for extracting an object such as a longitudinal nail or the like from an article comprising:

a frame;

object gripping jaw means mounted on said frame for movement in a longitudinal path between a position adjacent said article to grip said object and a removed position longitudinally away from said article to extract said object from said article;

means on said frame for longitudinally moving said jaw means between said adjacent and removed positions comprising screw means rotatable about its longitudinal axis and having screw threads defining a spiral slot thereon thread engaging lift means mounted on said object gripping jaw means for movement between a retracted position and a thread engaging position received by said spiral slot; and guide means for selectively guiding said thread engaging lift means to said thread engaging position so that said object gripping jaw means moves longitudinally away from said article as said screw means rotates in one direction and said jaw means moves from said adjacent position to said removed position but permitting movement of said lift means to said retracted position such that said jaw means can return to said adjacent position.

10. The device set forth in claim 9 including means mounting said jaw means on said frame and moveable in a longitudinal to and fro path of travel; yieldable means for urging said mounting means to a position adjacent said article and concurrently urging said jaw means to said radially contracted positions; said guide means and said thread engaging lift means being relatively rotatable; said guide means including longitudinal slot means for receiving said thread engaging lift means in said retracted position when said guide means and said thread engaging lift means are in at least one position of relative rotation so that said jaw means will return to said position adjacent said article.

11. The device as set forth in claim 9 wherein said screw means comprises a hollow cylinder which is positioned to internally receive a portion of said jaw means when said jaw means are in said removed positions, and has a screw thread on the inside of said cylinder.

12. A device for extracting an object such as an elongate nail or the like from an article comprising:

object gripping jaw means for gripping said object;

means mounting said jaw means for longitudinal movement between longitudinally outer positions adjacent said article and longitudinally withdrawn positions;

means for longitudinally withdrawing said object gripping jaw means between said longitudinally outer positions and said withdrawn positions comprising screw means threadably coupled to said object gripping jaw means, motion translating means for rotating said screw means comprising linearly reciprocable means longitudinally movable in a to and fro path and means coupled to said screw means and said reciprocable means for translating the linear motion of said reciprocable means in one direction to rotary motion to said screw means and longitudinally withdraw said object gripping jaw means to said withdrawn position.

13. The device set forth in claim 12 wherein one of said linearly reciprocable means and said motion translating means comprises spiral groove means and the other of said reciprocable means and said motion converting means comprises driver means having a portion received by said spiral groove means to rotate said converting means as said reciprocable means is linearly moved.

14. The device set forth in claim 13 wherein said reciprocable means and said screw means are mounted for relative rotation, said driver means being mounted for movement between a position drivingly coupled to said screw means and an uncoupled position; and cam means is provided for moving said driver means between said coupled and uncoupled positions in response to relative rotation of said reciprocable means and said screw means.

15. The device set forth in claim 14 wherein one of said reciprocable means and said cam means comprises linear groove means and the other of said reciprocable means and said cam means comprises means received by said linear groove means such that said cam means is rotated when said reciprocable means is rotated.

16. The device as set forth in claim 12 wherein said jaw means comprises a plurality of jaws mounted on said frame for radial movement between radially contracted positions and radially expanded positions.

17. A device for extracting an object such as a nail or the like from an article comprising:

object gripping jaw means for gripping said object;

means mounting said jaw means for longitudinal movement between longitudinally outer positions adjacent said article and longitudinally withdrawn positions;

means for longitudinally withdrawing said object gripping jaw means between said adjacent and withdrawn positions comprising linearly reciprocable drive means movable in a to and fro longitudinal path of travel; and rotatable means responsive to movement of said drive means in one direction only for linearly withdrawing said jaw means from said outer position to said withdrawn position.

18. The device as set forth in claim 17 including means for disabling rotation of said rotatable means such that said reciprocable drive means can be moved linearly in a direction toward said jaw means to set said jaw means onto an object without rotating said rotatable means.

19. The device as set forth in claim 17 including a frame, said jaw means comprise a plurality of object gripping jaws radially movable between radially expanded positions and radially contracted, object gripping positions, and means mounting said jaw means on said frame for compound movement longitudinally and radially relative to said frame such that said jaws will radially move between said contracted and expanded positions to grip said object when said frame is moved longitudinally toward said object.

* * * * *